US012656054B2

(12) United States Patent
Kennedy

(10) Patent No.: US 12,656,054 B2
(45) Date of Patent: Jun. 16, 2026

(54) PARTY ACCESSORY

(71) Applicant: Rhonda Kennedy, Port Mansfield, TX (US)

(72) Inventor: Rhonda Kennedy, Port Mansfield, TX (US)

(73) Assignee: Rhonda Kennedy, Port Mansfield, TX (US)

( * ) Notice: Subject to any disclaimer, the term of this patent is extended or adjusted under 35 U.S.C. 154(b) by 157 days.

(21) Appl. No.: 18/805,229

(22) Filed: Aug. 14, 2024

(65) Prior Publication Data

US 2025/0060152 A1 Feb. 20, 2025

Related U.S. Application Data

(60) Provisional application No. 63/519,761, filed on Aug. 15, 2023.

(51) Int. Cl.
*F25D 31/00* (2006.01)
*F25D 3/04* (2006.01)

(52) U.S. Cl.
CPC ..... *F25D 31/002* (2013.01); *F25D 3/045* (2013.01)

(58) Field of Classification Search
CPC .. F25D 31/002; F25D 3/045; F25D 2303/081; F25D 2331/806; F25D 3/06; B67D 3/0009; G06Q 50/12
See application file for complete search history.

(56) References Cited

U.S. PATENT DOCUMENTS 986,276 A * 3/1911 Freeman ..... F28D 7/024 165/163
1,221,916 A * 4/1917 Smith ..... B67D 3/0009 62/304
1,662,267 A * 3/1928 Horner ..... B67D 3/0009 62/391
4,407,356 A * 10/1983 DeLau ..... F28D 1/0213 165/169
4,494,600 A * 1/1985 DeLau ..... B67D 3/00 165/DIG. 348
4,599,872 A * 7/1986 Rist ..... F25D 3/08 62/399
2025/0060152 A1* 2/2025 Kennedy ..... F25D 3/045

FOREIGN PATENT DOCUMENTS

EP 949196 A1 * 10/1999
FR 378578 A * 10/1907
FR 747786 A * 6/1933
FR 2549587 A1 * 1/1985 ..... F25D 31/002
WO WO-8203119 A * 9/1982

* cited by examiner

*Primary Examiner* — Bob Zadeh
(74) *Attorney, Agent, or Firm* — D'Ambrosio & Menon, PLLC; Usha Menon

(57) ABSTRACT

A party accessory for dispensing a chilled beverage includes a container for receiving ice, a tube for dispensing the beverage, a stabilizer base and one or more interchangeable, customizable panels. The interchangeable panels can include an insert. The insert can be held in position by a plurality of fasteners or clips. The party accessory includes a spout for draining melted ice and a lighting compartment along a bottom surface of the container.

11 Claims, 11 Drawing Sheets

PARTY ACCESSORY

CROSS-REFERENCE TO RELATED APPLICATIONS

This application claims the benefit of Provisional U.S. Patent Application No. 63/519,761, filed Aug. 15, 2023, entitled "Party Accessory", the entire content and disclosure of which, both express and implied, is incorporated herein by reference.

FIELD OF THE INVENTION

The present invention relates to a party accessory and, in particular, to a party accessory device for dispensing a chilled beverage.

BACKGROUND

Ice luges are event-specific custom sculptures made from solid blocks of ice for dispensing a beverage. Ice luges have a narrow channel or track that is carved into the ice block. Some designs include a tube incorporated within the sculpture to convey the beverage from the top to the base. A user (for example, a bartender) can pour a single shot of a beverage, usually, an alcoholic beverage, onto the top of the block from where it flows down the channel into the mouth of a consumer or into a shot glass. Ice luges are used in party settings for playing drinking games.

However, there are many drawbacks with conventional ice luges. Since ice luges are carved out of large ice blocks, they are extremely heavy and require physical exertion when they have to be lifted or moved. Ice luges must be delivered via a refrigerated truck since they can melt within a few hours under ambient temperature. The melting ice can leave a large, messy puddle. Thus, conventional ice luges are usable only for a short time. Additionally, an ice luge is custom designed for a specific party or event and cannot be reused. Conventional ice luges are also expensive since they require manpower for creation, delivery and set up. It is not uncommon for ice luges to cost several hundreds of dollars.

Accordingly, there is a need for a party accessory that can be used for playing drinking games but does not have the drawbacks of conventional ice luges.

SUMMARY OF THE INVENTION

In accordance with one or more embodiments, the invention relates to a party accessory for dispensing a chilled alcoholic or non-alcoholic beverage. The party accessory is a reusable, non-melting, lightweight device that can be customized for a variety of events, such as, football tailgating, birthday parties, anniversary parties, graduation parties, company holiday parties, New Year's Eve parties or other special occasions.

The party accessory can be configured to be filled with ice at the party/event. This makes it lightweight and easy to transport. Advantageously, since the party accessory is not carved from ice, it can be used for a long period of time, from several hours to multiple days. The party accessory does not require special refrigerated trucks for transportation, nor does it require multiple personnel for lifting and transporting it to an event site.

According to an embodiment, a party accessory for dispensing a chilled beverage includes: a container, wherein the container defines a hollow interior cavity, wherein the container further comprises: a lid, wherein the lid is removably coupled to a top surface of the container; a tube, wherein the tube extends through the interior cavity; and an opening on a wall of the container, and wherein a second end of the tube is configured to extend outside the opening on the wall of the container; and a stabilizer base, wherein the container is positioned within the stabilizer base. The cavity is configured for holding a cooling medium. In one embodiment, the cooling medium is ice.

The lid can include a first lid panel and a second lid panel, wherein the first lid panel is coupled to the second lid panel. A hinge enables the opening and closing of the first and/or second lid panel. At least one of the lid panels includes a hole. In one embodiment, a first end of the tube is inserted into the hole. In another embodiment, a funnel is inserted into the hole, and wherein the funnel is configured to facilitate a spill-proof pour of the beverage. A first end of the tube can be inserted into a stem of the funnel.

In one embodiment, the base comprises: a first base member; and a second base member, wherein the first base member is configured to be received within a central opening in the second base member.

The party accessory also includes a drainage spout disposed on a sidewall of the container. The drainage spout is configured to facilitate drainage of melted ice from inside the container.

The party accessory further comprises one or more customizable decorative panels, wherein the one or more panels are configured to be coupled to one or more sidewalls of the container.

One or more handles can be configured to connect a first panel with a second panel. Each of the one or more panels has a plurality of fasteners on an interior surface. The fasteners are configured to hold an insert.

The party accessory further includes a lighting compartment located along a bottom surface of the container.

Various objects, features, aspects, and advantages of the inventive subject matter will become more apparent from the following detailed description of preferred embodiments, along with the accompanying drawing figures in which like numerals represent like components.

BRIEF DESCRIPTION OF THE DRAWINGS

The invention will be described in further detail below and with reference to the attached drawings all of which describe or relate to the party accessory and method use of the present invention. In the figures, which are not intended to be drawn to scale, each similar component that is illustrated in various figures is represented by a like numeral. In the figures.

DETAILED DESCRIPTION OF THE INVENTION

Depending on the context, all references below to the "invention" may in some cases refer to certain specific embodiments only. Various terms are used herein. To the extent a term used in a claim is not defined below, it should be given the broadest definition persons in the pertinent art have given that term as reflected in printed publications and issued patents at the time of filing.

Figure 1A:
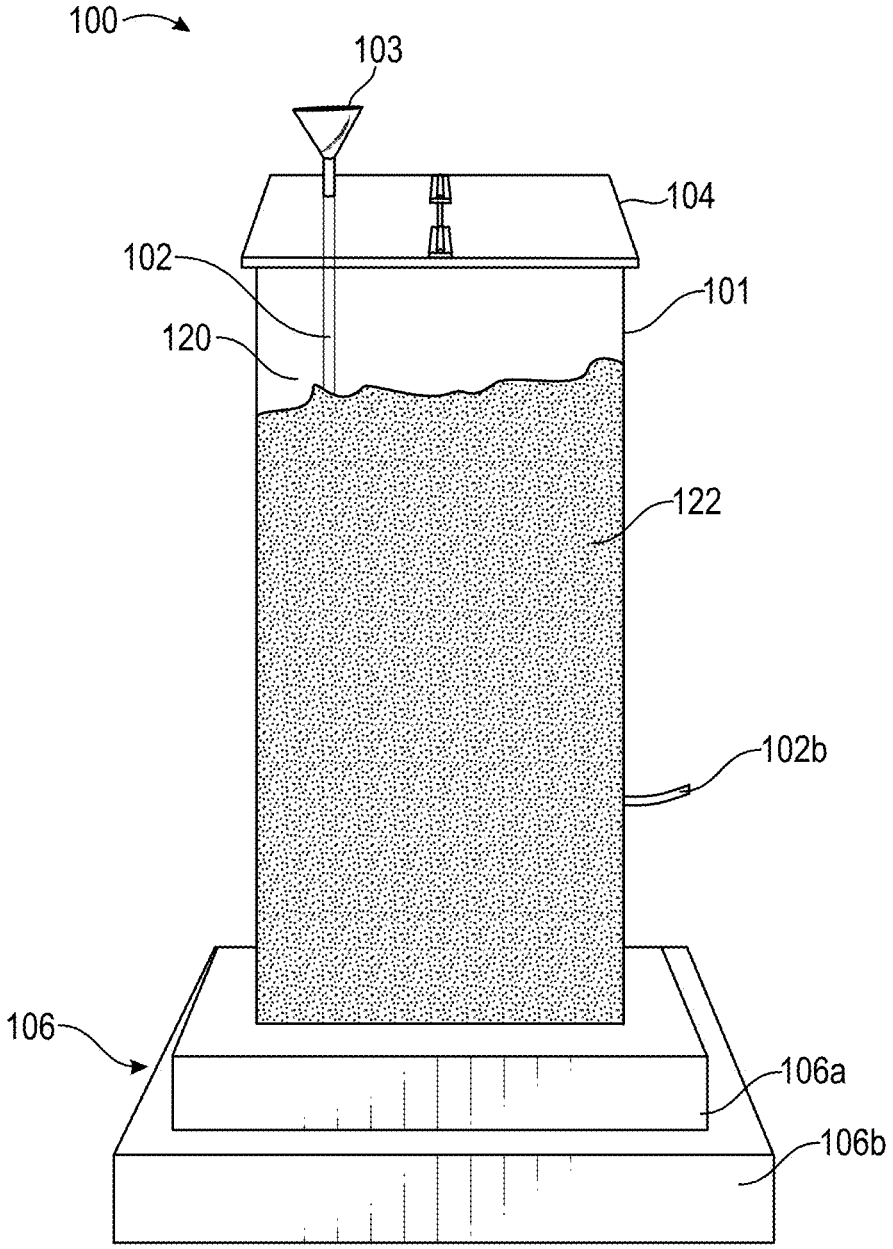
FIGS. 1A-1C illustrate a party accessory according to an embodiment.
Figure 1B:
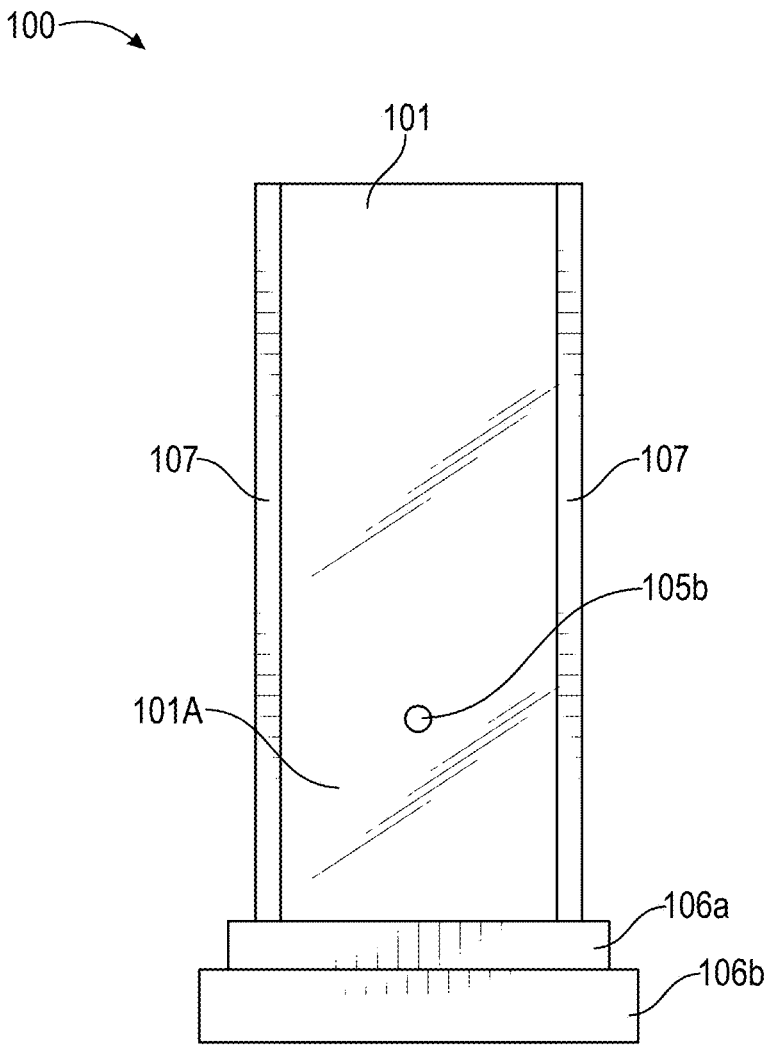
Figure 1C:
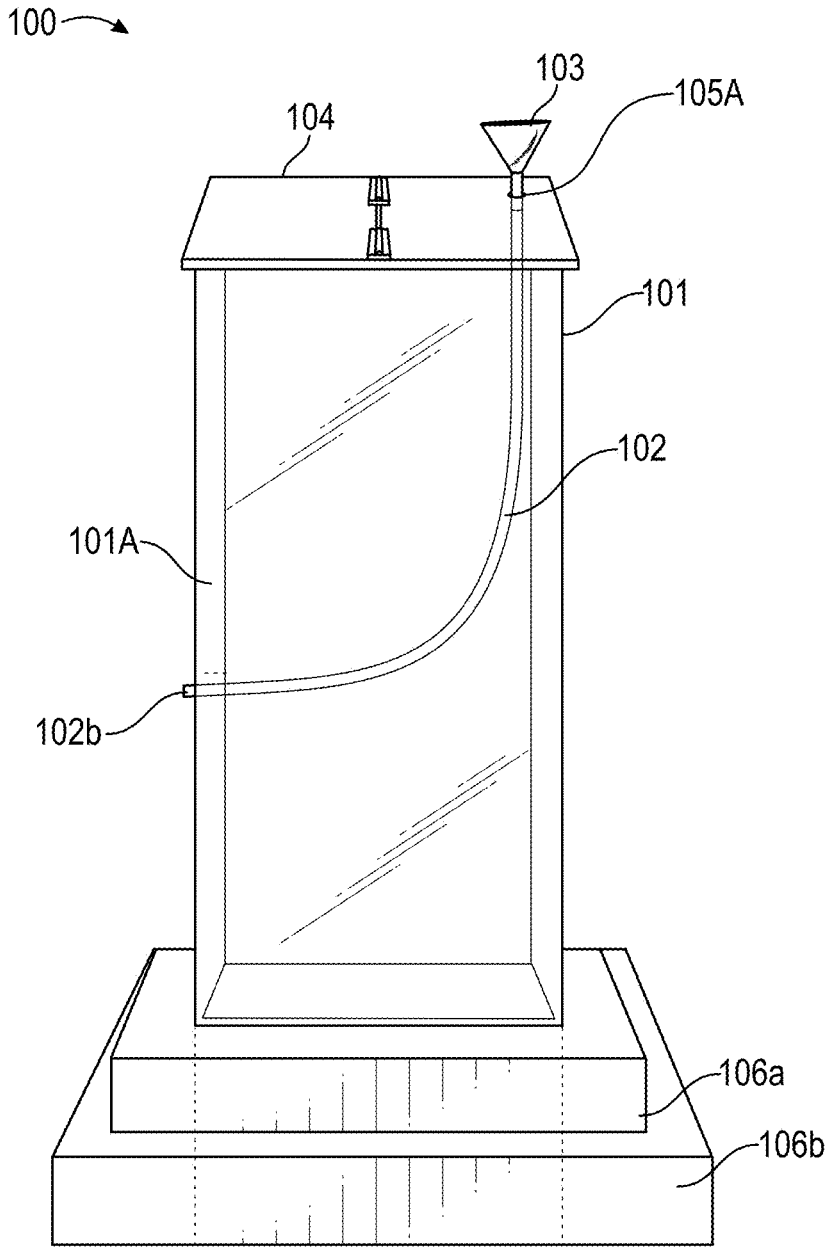

FIGS. 1A-1C illustrate various views of an embodiment of party accessory 100. The party accessory 100 can be used instead of a conventional ice luge to dispense alcoholic or non-alcoholic beverages (hereinafter referred to as "beverages").

The party accessory 100 can include a container 101. As used herein, the term "container" includes a tank or vessel for storing ice, fluids or any cooling medium. The container 101 defines a hollow interior cavity 120 for receiving and storing ice, fluid or another suitable cooling medium 122. Preferably, in one or more embodiments, the container 101 is made of a clear or transparent material such that a user can see through it. For example, the container 101 can be made of a clear acrylic. The container 101 can be made of a suitable lightweight material. In an exemplary embodiment, the container 101 can be about 36 inches in height, 10 inches in width, 15 inches in length.

In one exemplary embodiment, the container 101 is substantially quadrilateral in shape. The container 101 comprises a front wall 101A, an opposing rear wall, a pair of opposing sidewalls, a top surface and a bottom surface (not shown). However, it is understood that the container 101 can be tubular or have any suitable shape. The top surface of the container 101 can include a removable lid 104. The lid 104 includes an opening for receiving a first end of tubing/tube 102. In another embodiment, the first end of the tube 102 is inserted within the stem of a funnel 103. The funnel 103 facilitates a spill-proof pour of a stream of a desired beverage. In one or more embodiments, the funnel 103 can be configured with a lid (not shown). The tube 102 is configured to extend within the cavity 120. The tube 102 is configured to transfer a beverage from its first end to a second end 102*b*, where the second end of the tube extends outside a wall of the container 101.

An opening/aperture 105*b* is formed on a wall, such as, the front wall 101A of the container 101. The opening 105*b* is dimensioned such that the second end of the tube 102*b* can be securely inserted through the opening 105*b* and extend outside the container 101. In an embodiment, the opening 105*b* can be located about 14 inches from the bottom of the base 106. In yet another embodiment, the bottom surface of the container 101 can be placed over a solid base (not shown).

The second end 102*b* can be configured to be inserted into a suitable beverage holder (not shown). In one embodiment, the beverage holder can include a beverage container, such as, a shot glass, a beer glass and any other suitable receptacle. Alternately, in one or more embodiments, the second end of the tube 102*b* can be configured to be directly placed within the mouth of a person consuming the beverage such that the beverage can dispensed through the opening on the second end of the tube 102.

Figure 3:
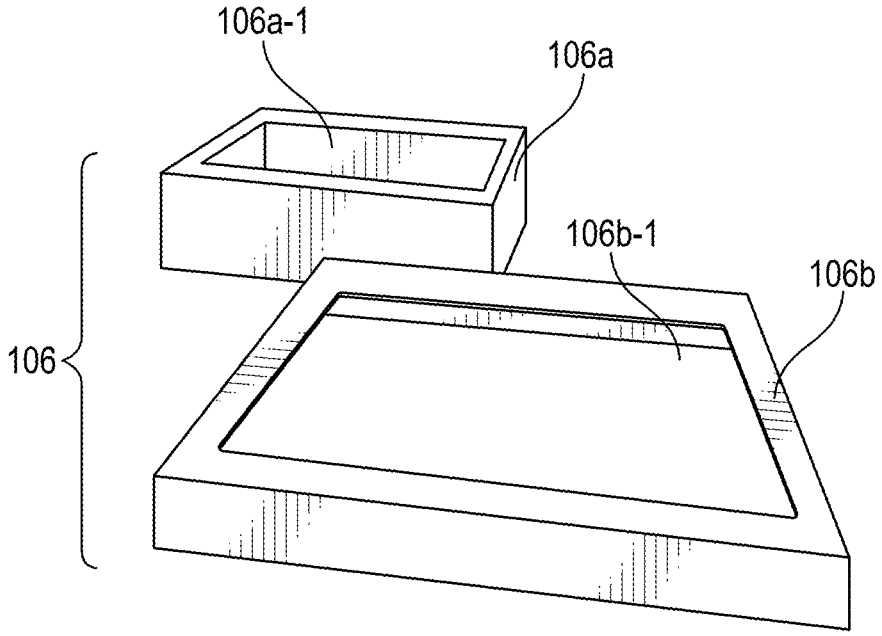
FIG. 3 illustrates the container base according to an embodiment.

The bottom surface of the container 101 can be securely positioned within an opening in a container base 106. The base 106 can include at least two base members 106*a*, 106*b*. As further shown in FIG. 3, each base member 106*a*, 106*b* has a central opening 106*a*-1, 106*b*-1. The base members can have a suitable shape, such as, a rectangular or square shape. A first base member, or an inner base member, 106*a* can be configured to securely receive the container 101 within its central opening 106*a*-1. The second base member, or an outer base member, 106*b* is dimensioned such that the first base member 106*a* can be received within its central opening 106*b*-1 and securely hold the first base member 106*a* within its opening. The first base member 106*a* can be about 5 inches in height, 13 inches in width, and 18 inches in length, while the second base member 106*b* can be about 3 inches in height, 16 inches in width, and 21 inches in length.

The base members 106*a*, 106*b* are configured to stabilize the container 101 by providing a stable foundation for the container 101 and are configured to prevent the container 101 from tilting or toppling over when in use.

Figure 2A:
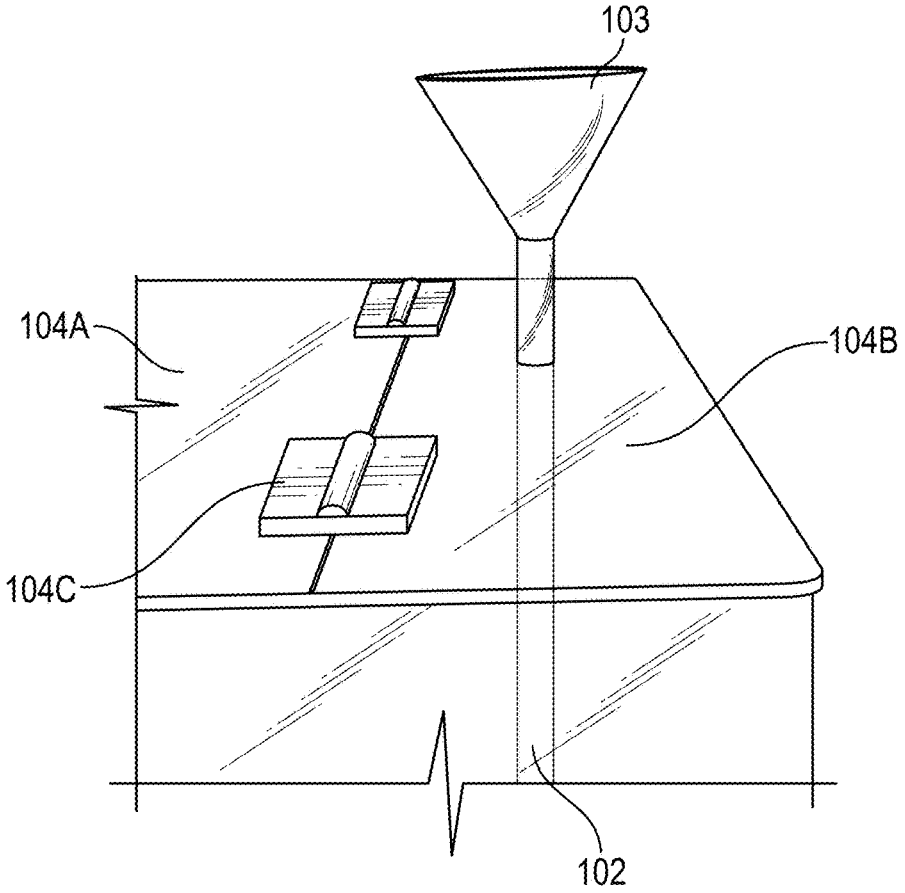
FIGS. 2A-2B illustrate the lid of the party accessory according to an embodiment.
Figure 2B:
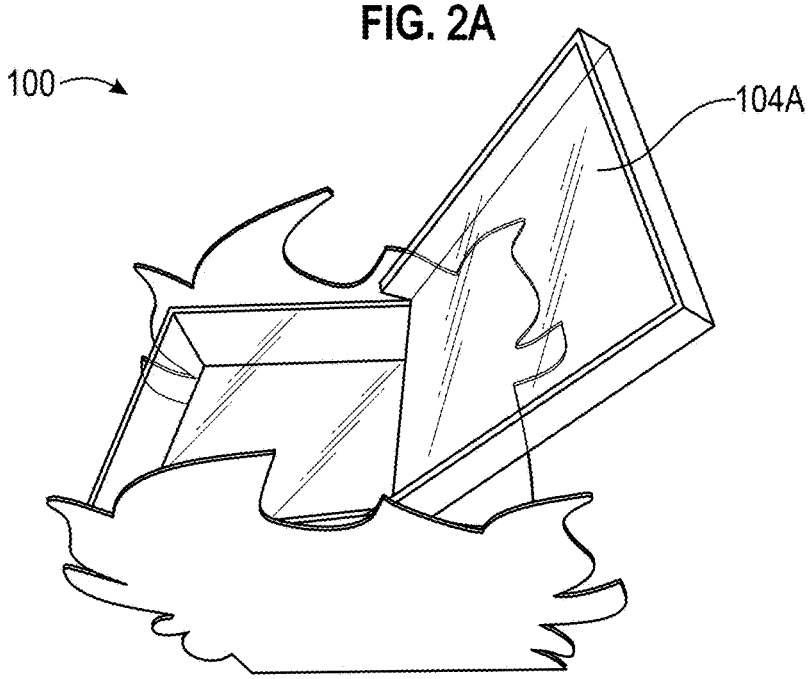

Now referring to FIGS. 2A-2B, the lid 104 can include two lid panels 104A, 104B, wherein the first lid panel 104A is coupled to the second lid panel 104B using a suitable connector or coupling mechanism. A hinge mechanism 104C enables the opening and closing of the first and/or second lid panels 104A, 104B. When at least one lid panel, such as, the first lid panel 104A, is in an open position, the interior cavity 120 can be filled with ice 122.

An opening 105*a* can be formed on a first 104A or second lid panel 104B. The opening 105*a* can be dimensioned to receive a first end of the tube 102. As described earlier, a funnel 103 can be inserted within the first end/opening of the tube. The party accessory 100 is convenient and easy to operate. In use, a lid panel, such as, the first lid panel 104A can be opened and the interior cavity 120 can be filled with ice 122. The desired beverage can be poured through the funnel 103 into the tube 102. The ice-filled interior cavity 120 of the container 101 is configured to ensure that the beverage is chilled as it travels through the tube passageway before it exits through the opening on the second end of the tube 102. Thus, the party accessory 100 is configured to dispense a chilled beverage.

Figure 4:
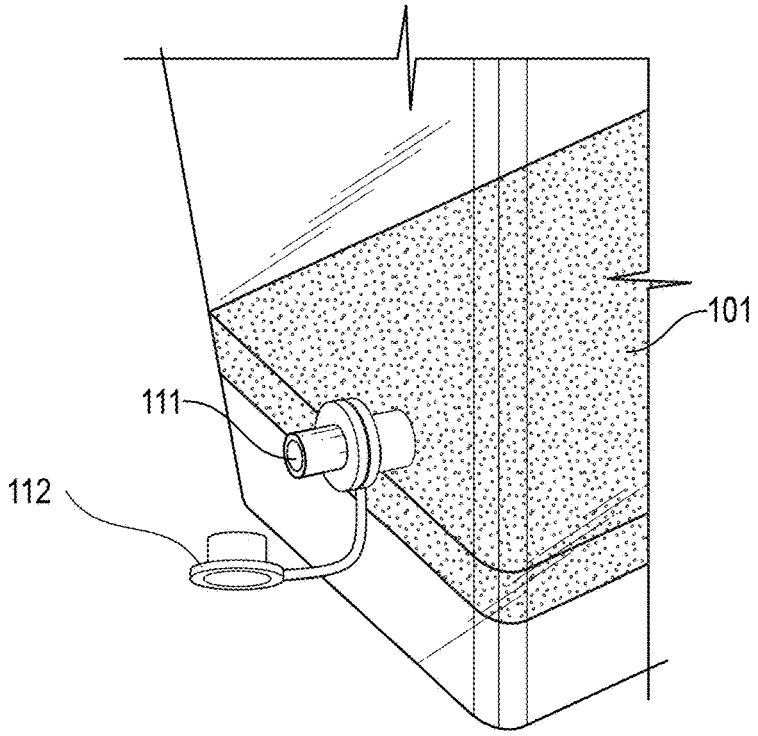
FIG. 4 illustrates the drainage spout of the party accessory according to an embodiment.

Now referring to FIG. 4, a sidewall or rear wall of the container 101 can include an opening for a drainage spout 111. The drainage spout 111 is located proximal to the bottom surface of the container 101. The spout 111 can include a cap 112. When the cap 112 is opened, the drainage spout 111 facilitates convenient and hassle-free drainage of melted ice/water without having to tilt the container 101.

Figure 5:
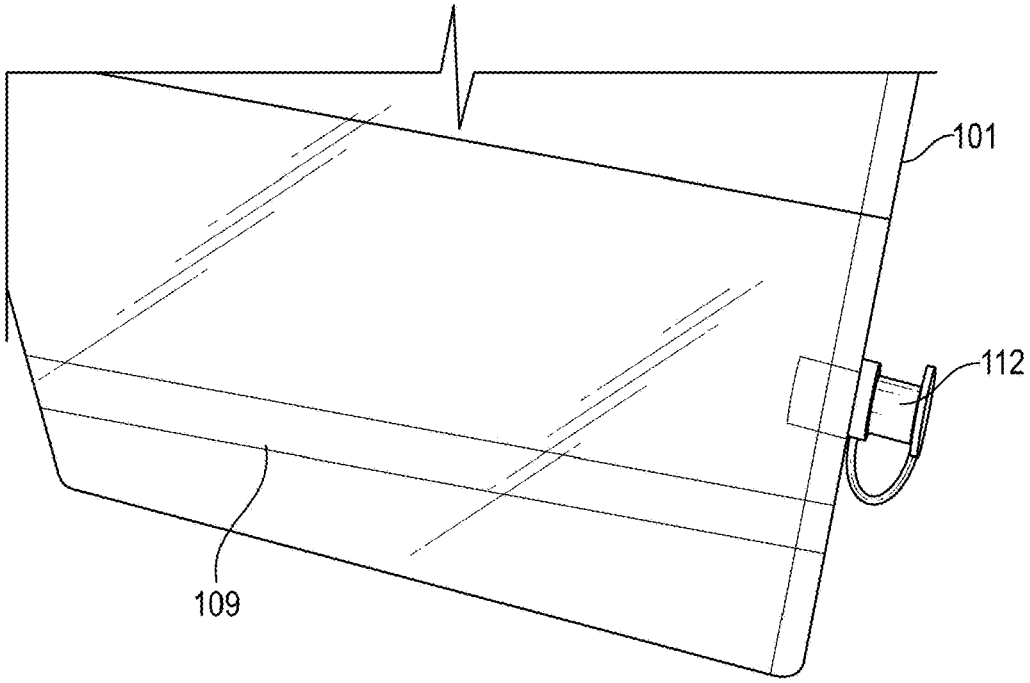
FIG. 5 illustrates a lighting compartment of the party accessory according to an embodiment.

As shown in FIG. 5, the bottom surface of the container 101 can be configured with a lighting compartment 109 to provide lighting and additional visual interest to the party accessory 100. The lighting compartment 109 can be configured to house a suitable lighting component (not shown). In an exemplary, the lighting component can be battery operated.

In one or more embodiments, the party accessory 100 can be configured to receive one or more interchangeable, decorative, and customizable side panels ("panels"). FIGS. 6A-6D illustrate multiple embodiments of interchangeable panels 107 that can be coupled to one or more opposing sidewalls, the front wall 101A and/or the rear wall of the container 101. Further, a first panel 107 can be configured to be coupled or connected to an adjacent panel using a handle (as discussed hereinafter). In one or more embodiments, one or more connected panels 107 can be configured to surround the container 101 on two or more sides. At least a first surface, such as, an outward facing surface/exterior surface of the panels 107 can be customized with messages, graphics, etc. for a variety of events, such as, football tailgating, birthday parties, anniversary parties, graduation parties, company holiday parties, New Year's Eve parties or other special occasions. The panels 107 can also be configured to have any desired shape (such as, a birthday cake, a football, a flame, etc.).

Figure 6A:
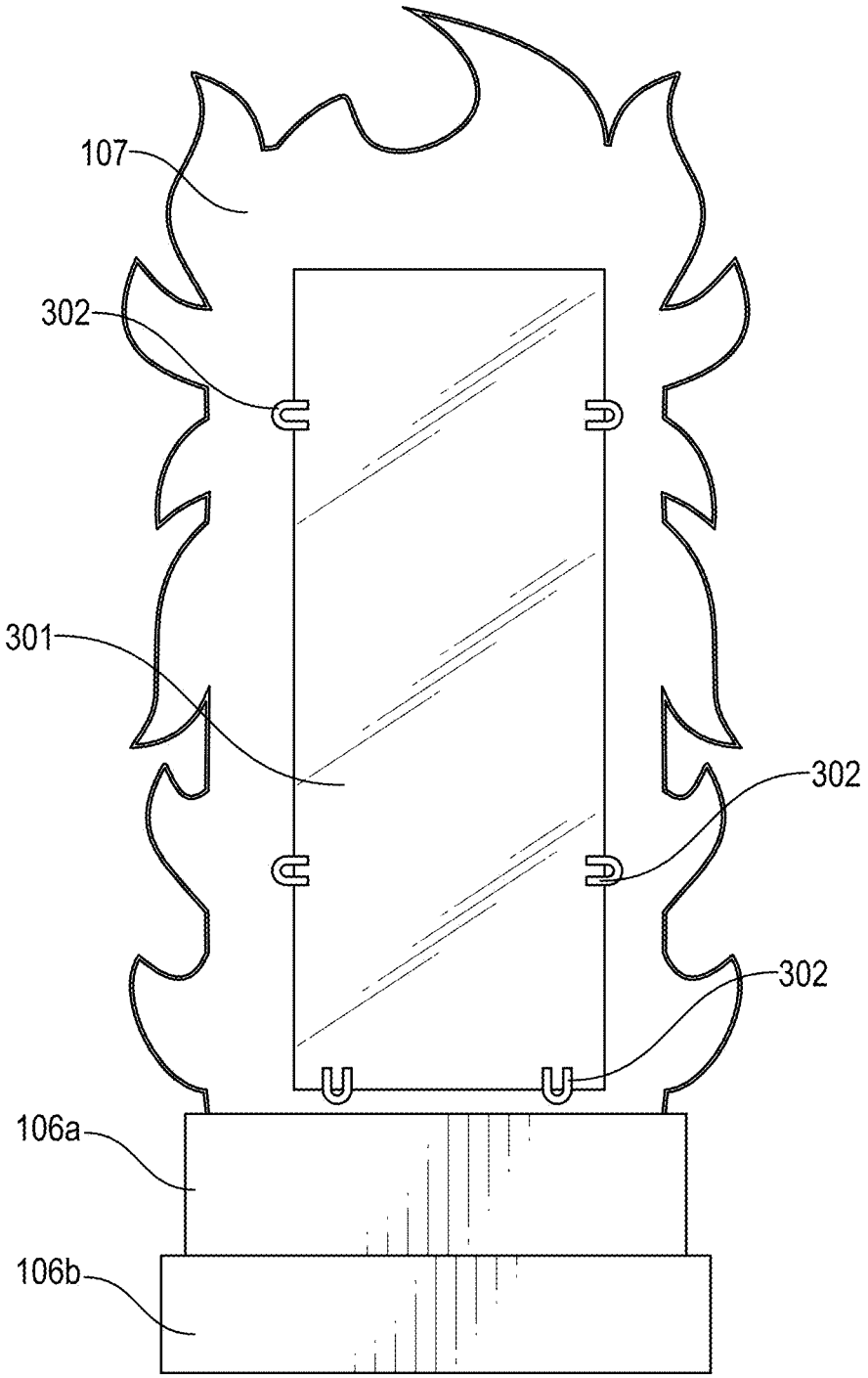
FIGS. 6A-6D illustrate multiple interchangeable panels for the party accessory according to an embodiment.
Figure 6B:
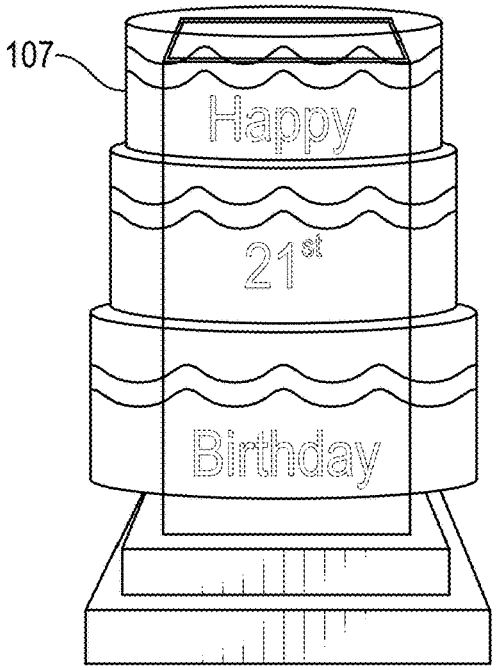
Figure 6C:
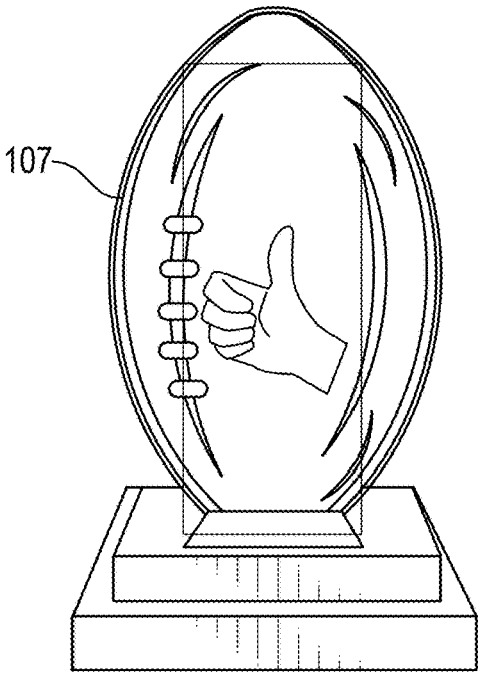
Figure 6D:
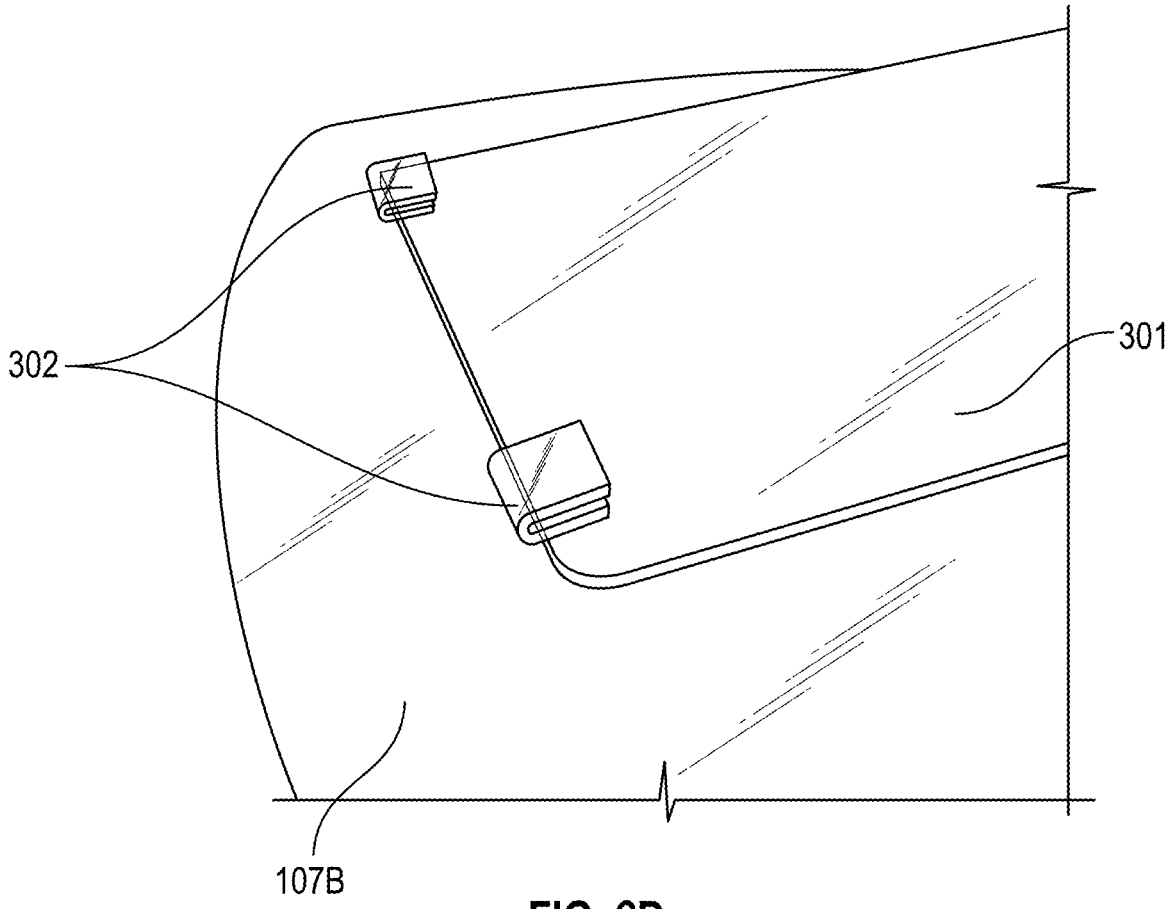

As shown, particularly with reference to FIGS. 6A and 6D, a second surface, such as, an inward facing surface/interior surface 107B of the panel comprises an insert 301. In one or more embodiments, the insert 301 can be manufactured from a clear acrylic material. A plurality of fasteners 302 are configured to affix the insert 301 to the interior surface 107B of the panel. The fasteners 302 can be made of a clear material and can be arranged equidistant from each other. In one or more embodiments, the fasteners 302 can be split pins or u-clips and be u-shaped to secure the insert in place on the interior surface 107B. In an embodiment, the fasteners 302 can be about 0.5 inches and the insert 301 can be about. 125 inches in thickness, 12 inches in width, and 24 inches in height.

In an embodiment, the insert 301 can be configured as a message board. For example, a desired message, such as, a birthday wish, or a logo, can be printed and placed within insert 301. Alternately, the desired message can be painted on the insert 301. In one or more embodiments, vinyl cutters can be used to for customize the messages inserted into the insert.

Figure 7A:
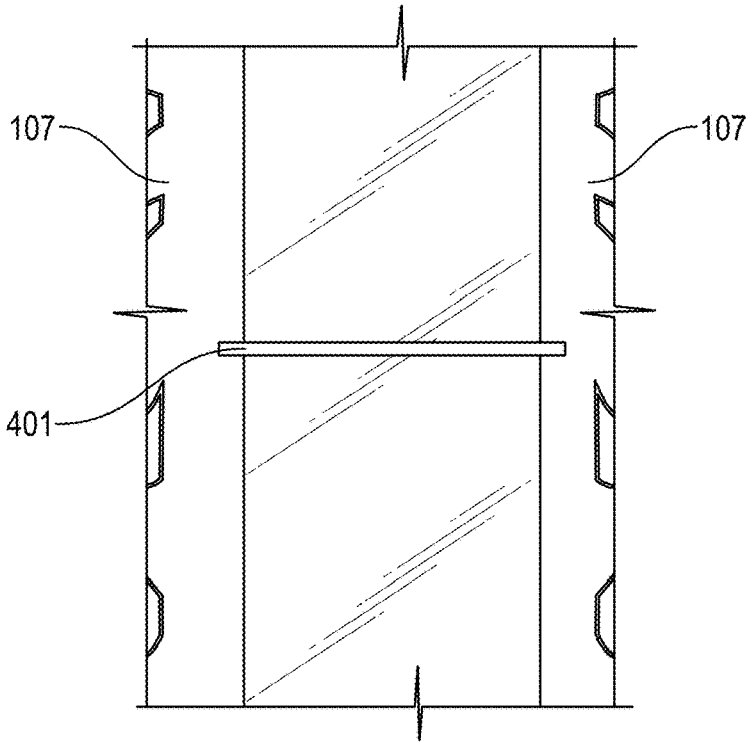
FIGS. 7A-7C illustrate a handle and its components of the party accessory according to another embodiment.

As shown in FIG. 7A, each panel 107 can be coupled to an adjacent panel using a handle 401. In one or more embodiments, multiple panels 107 (for instance, three panels) can be positioned around the central container 101 by using one or more handles 401.

Figure 7B:
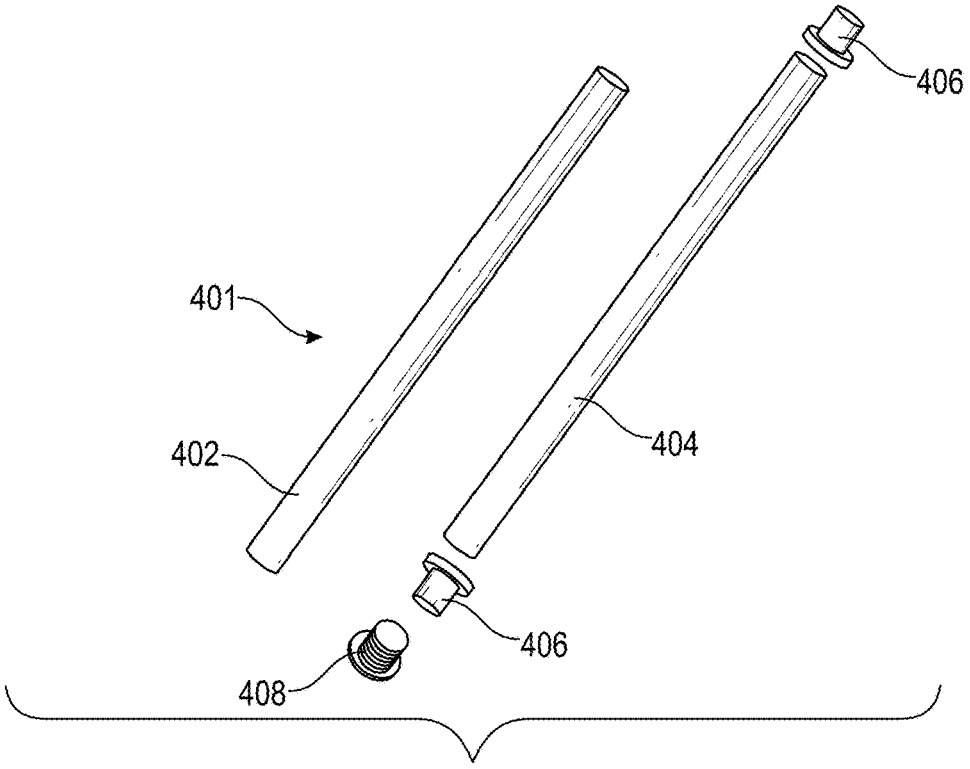

As shown in FIG. 7B, handle 401 comprises a tube member 402, a bar member 404, one or more threaded posts 406 and screws/fasteners 408. In one or more embodiments, the tube member 402 can be a clear cylinder having a diameter of about 0.5 inches and a length of about 11 inches, while the bar member 404 can be a solid cylinder having a diameter of about 0.375 inches and a length of about 10 inches. In an exemplary embodiment, the tube and bar members can be made of plastic, PVC, or acrylic, or another suitable material. The post 406 and fastener 408 can be about 0.375 inches in diameter and can be made of a polycarbonate. The post 406 can be coupled, for example, with glue, to the bar member 404. The bar member 404 can be inserted within the tube member 402 and it can be coupled to the interior of the tube member. The screw 408 can be coupled to the panel 107 and the screw 408 is attached to the post 406 to connect two interchangeable panels 107. In an example, the party accessory 100 can be provided with around three sets of handles 401.

Figure 7C:
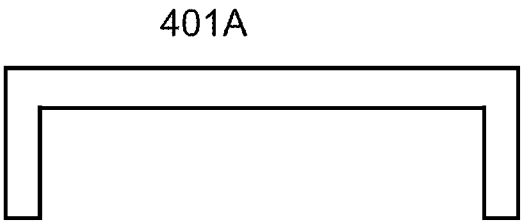

FIG. 7C illustrates another embodiment of the handle 401. As shown, the handle 401A comprises a bracket that can be placed across the top of the container 101 (proximal to the hinges 104C) and is attached to each of the decorative panels 107 (with, for example, double sided tape) to add extra stability. The handle 401A can made with acrylic that is bent at each end. In an exemplar embodiment, the handle 401A can be 10 inches wide by 1 inch deep.

Current ice luges need to be manually sculpted/carved for each specific event. In contrast, the party accessory 100 comprises portable, pre-made components (such as, the container, tube, handles, interchangeable panels, stabilizer blocks) which can be easily transported to and from a desired site. Advantageously, the party accessory 100 can be assembled on-site. The party accessory 100 can be easily customized with the interchangeable and custom panels 107. The party accessory 100 is easy to transport since it is made of lightweight materials. The party accessory 100 can be filled with ice at an event site. Moreover, as the ice melts, the party accessory 100 can be refilled with more ice via the hinged lid 104, making the party accessory 100 usable for extended periods of time. In one or more embodiments, the lid can be configured with multiple openings to receive a plurality of tubes 102. This allows a variety of beverages to be dispensed simultaneously.

Advantageously, the party accessory 100 can also be disassembled to be easily transported and stored when not in use. The premade components of the party accessory 100 also allow the accessory to be easily cleaned, since the components have a manageable size. Furthermore, a variety of panels 107 can be stored for each occasion for the party accessory 100.

Thus, the party accessory 100 is a less expensive/cost-effective, re-usable, lightweight device that can be customizable for any required occasion/event using a home computer/printer. The party accessory 100 is easy to clean and store and no refrigerated truck is necessary for delivery. With proper use and maintenance, the party accessory 100 can be used for a relatively long period of time.

The party accessory 100 can be used in/sold by bar owners, party supply stores, party equipment rental companies, annual company parties, cookoff teams, tailgate parties, or anyone that is interested in having a fun event.

In this document and appended claims, the terms "comprises," "comprising," "has," "having," "includes," "including," "contains", "containing" or any other variation thereof, are intended to cover a non-exclusive inclusion, such that a process, method, article, or apparatus that comprises, has, includes, contains a list of elements does not include only those elements but may include other elements not expressly listed or inherent to such process, method, article, or apparatus.

As used herein, the term "configured to," "configured with," "arranged to," "arranged with," "capable of" and any like or similar terms means that referenced elements have a physical arrangement and/or physical coupling and/or connectivity with other elements.

Also, the terms "front wall," "rear wall," "sidewalls" "interior surface", "inner", "outer", and the like in the description are used for descriptive purposes and not necessarily for describing permanent relative positions. It is understood that the terms so used are interchangeable under appropriate circumstances such that the embodiments of the invention described herein are, for example, capable of operation in other orientations than those illustrated or otherwise described herein.

Furthermore, the terms "a" or "an," as used herein, are defined as one or more than one. Also, the use of introductory phrases such as "at least one" and "one or more" should not be construed to imply that the introduction of another element.

Therefore, the present invention is well adapted to attain the ends and advantages mentioned as well as those that are inherent therein. The previous description is not intended to limit the invention, which may be used according to different aspects or embodiments without departing from the scope thereof. The discussion of steps, materials, accessory, articles and the like is included in this specification solely for the purpose of providing a context for the present invention. It is not suggested or represented that any or all of these matters formed part of the prior art or were common general knowledge in the field relevant to the present invention.

While the foregoing describes various embodiments of the invention, other and further embodiments of the invention may be devised without departing from the basic scope thereof. The scope of the invention is determined by the claims that follow. The invention is not limited to the described embodiments, which are included to enable a person having ordinary skill in the art to make and use the invention when combined with information and knowledge available to the person having ordinary skill in the art.

The invention claimed is:

1. A party accessory for dispensing a chilled beverage, comprising:

a container, wherein the container defines a hollow interior cavity, wherein the container further comprises:

a lid, wherein the lid is removably coupled to a top surface of the container;

a tube, wherein the tube extends through the interior cavity; and an opening on a wall of the container, and wherein a second end of the tube is configured to extend outside the opening on the wall of the container; and a stabilizer base, wherein the container is positioned within the stabilizer base, and wherein the interior cavity is configured for holding a cooling medium, wherein the lid comprises a first lid panel and a second lid panel, and wherein the first lid panel is coupled to the second lid panel, wherein the lid comprises a hinge for opening and closing the first and/or second lid panel, wherein at least one of the lid panels includes a hole, and wherein a first end of the tube is inserted into the hole.

2. The party accessory according to claim 1, wherein a funnel is inserted into the hole, and wherein the funnel is configured to facilitate a spill-proof pour of the beverage.

3. The party accessory according to claim 2, wherein the first end of the tube is inserted into a stem of the funnel.

4. The party accessory according to claim 1, wherein the cooling medium is ice.

5. The party accessory according to claim 4, further comprising a drainage spout disposed on a sidewall of the container.

6. The party accessory according to claim 5, wherein the drainage spout is configured to facilitate drainage of melted ice from the container.

7. The party accessory according to claim 6, further comprising one or more handles, and wherein a first handle is configured to connect a first panel with a second panel.

8. The party accessory according to claim 6, wherein each of the one or more panels has a plurality of fasteners on an interior surface, and wherein the plurality of fasteners is configured to hold an insert.

9. The party accessory according to claim 1, wherein the base comprises:

a. a first base member; and b. a second base member, wherein the first base member is configured to be received within a central opening in the second base member.

10. The party accessory according to claim 1, further comprising one or more customizable decorative panels, wherein the one or more panels are configured to be coupled to one or more sidewalls of the container.

11. The party accessory according to claim 1, further comprising a lighting compartment located along a bottom surface of the container.

* * * * *